US006323831B1

(12) United States Patent
Ono et al.

(10) Patent No.: US 6,323,831 B1
(45) Date of Patent: Nov. 27, 2001

(54) ELECTRON EMITTING DEVICE AND SWITCHING CIRCUIT USING THE SAME

(75) Inventors: Tomio Ono; Tadashi Sakai; Naoshi Sakuma, all of Yokohama; Kazuya Nakayama, Sagamihara, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/153,086

(22) Filed: Sep. 15, 1998

(30) Foreign Application Priority Data

Sep. 17, 1997 (JP) ..... 9-252355
Sep. 18, 1997 (JP) ..... 9-253299
Mar. 16, 1998 (JP) ..... 10-065760

(51) Int. Cl.[7] ..... G09G 3/22
(52) U.S. Cl. ..... 345/75.2
(58) Field of Search ..... 345/74.1, 75.1, 345/75.2, 76; 315/169.1, 169.3

(56) References Cited

U.S. PATENT DOCUMENTS 5,483,118 1/1996 Nakamoto et al. .
5,499,938 3/1996 Nakamoto et al. .
5,592,056 * 1/1997 Peyre et al. ..... 315/169.1
5,727,976 3/1998 Nakamoto et al. .
5,977,719 * 11/1999 Makishima et al. ..... 315/169.1

FOREIGN PATENT DOCUMENTS 2-226635 9/1990 (JP) .
8-195175 7/1996 (JP) .
8-315741 11/1996 (JP) .

OTHER PUBLICATIONS

U.S. application No. 09/153,086, filed Sep. 5, 1998, pending.
U.S. application No. 09/606,013, filed Jun. 29, 2000, pending.

* cited by examiner

*Primary Examiner*—Chanh Nguyen
(74) *Attorney, Agent, or Firm*—Oblon, Spivak, McClelland, Maier & Neustadt, P.C.

(57) ABSTRACT

An electron emitting comprising an emitter electrode for emitting electrons when applied with an electric field, a gate electrode for extracting the electrons emitted from the emitter electrode, when applied with a voltage from a signal source, the voltage being positive with respect to the emitter electrode, an anode electrode connected to a load, for collecting the electrons extracted by the gate electrode, and for passing an anode current, and a gate resistor connected between the signal source and the gate electrode, for reducing a gate current flowing in the gate electrode, without changing an anode current flowing in the anode, and for lowering a gate voltage by utilizing a voltage drop cause by the gate current.

24 Claims, 12 Drawing Sheets

ELECTRON EMITTING DEVICE AND SWITCHING CIRCUIT USING THE SAME

BACKGROUND OF THE INVENTION

The present invention relates to an electron emitting element and a switching circuit using the electron emitting element. More particularly, the invention relates to an electron emitting device for use in effecting a switching operation in a linear region, and also to a switching circuit using the electron emitting device.

In recent years, electron emitting elements of field-emission type have been developed, by applying the advanced Si semiconductor microfabrication technique. These elements are as small as semiconductor devices and are expected to be used in flat panel displays and the like. A representative type of an electron emitting element is disclosed in C. A. Spindt et al., Journal of Applied Physics, vol. 47, 5248 (1976).

In the conventional electron emitting element, a positive voltage is applied to the gate electrode, thereby generating an intense electric field at the emitter. The electric field attracts electrons from the emitter into a vacuum. Meanwhile, a positive voltage higher than the voltage applied to the gate electrode is applied to the anode electrode, which opposes the emitter. The electrons moving from the emitter toward the gate electrode are thereby attracted to the anode electrode. Thus, the electrons emitted from the emitter are collected at the anode electrode.

In the electron emitting element, the number of electrons emitted from the emitter is determined by only the intensity of the electric field generated at the tip of the emitter. Generally, the anode electrode is much more spaced from the emitter than the gate electrode is spaced therefrom, so that the number of emitted electrons, i.e., current is determined only by the gate voltage. If the anode voltage is low, the electrons emitted from the emitter are strongly attracted to the gate electrode. As a result, the electrons move to the gate electrode and do not reach the anode electrode.

As the anode voltage increases, the number of electrons moving toward the gate electrode decreases and the number of electrons moving toward the anode electrode increases. When the anode voltage becomes sufficiently high, all electrons emitted from the emitter reach the anode electrode.

The operating characteristics of the electron emitting element, described above, make no problem when the element is used in an apparatus, such as a flat panel display, wherein the anode current is controlled by the gate current. The characteristics make a problem, however, when the element is used as a power switching element by utilizing the high insulating property of a vacuum.

When the electron emitting element is used in a switching circuit, it is connected between a load having an impedance Z and a power supply having a voltage $V_0$. If the element performs switching operation in its saturation region, the anode voltage will increase, inevitably causing a large power loss.

Moreover, the electron emitting element lacks in operating reliability due to the difference between its characteristics and its design characteristics. This is particularly because the anode current is determined by the gate voltage, irrespective of the size of the load and the power-supply voltage.

Due to its above-mentioned disadvantageous aspects, the electron emitting element is operated in its linear region when it is used in a switching circuit to emit electrons. When the electron emitting element is operated in its linear region, the gate current is of the same order as the anode current while the element remains on during the switching operation. Consequently, a large power loss takes place at the gate, which should be controlled. Further, the element is likely to break down since an excessive gate current flows.

An electron emitting element for use in a switching circuit has an array of conical emitters. It is difficult to sharpen the tips of the emitters in the same manner and to space them from the gate at the same distance. It is therefore impossible for the conical emitters to emit electrons in the same way. More specifically, the emitters start emitting electrons at different gate voltages. Thus, as the gate voltage is increased, the currents flowing in some emitters reach an upper limit before the currents flowing in the other emitters reach an upper limit. As a consequence, the first-mentioned emitters are short-circuited to the gate. Current inevitably flows between the emitters and the gate, disabling the emitter array to perform its function.

An electron emitting element that is free of this problem is disclosed in Ghis et al., IVMC90 Technical Digest. This element comprises a glass substrate, a mesh-shaped emitter lines provided on the substrate, and a resistor layer covering the emitter lines. The element further comprises an $SiO_2$ layer provided on the resistor layer, a gate layer formed on the $SiO_2$ layer, and conical emitters arranged on the Mo layer.

In this electron emitting element, the resistor layer is interposed between the emitter lines and the emitters. Hence, as each emitter outputs a current, its potential increases, decreasing the potential difference between the emitter and the gate. As a result, the output current of the emitter decreases. Namely, the resistor layer performs negative feedback. The negative feedback works on some emitters which start emitting electrons at a low gate voltage more strongly than on other emitters, which starts emitting electrons at a higher gate voltage. Thanks to the negative feedback, it becomes difficult to short-circuit between the emitters and the gate for making all emitters have the same electron-emitting characteristic. Even if any emitter were short-circuited, the emitter array would not be disabled to operate. This is because the resistor layer receives the gate voltage.

The electron emitting element having a resistor layer provided near the emitters works well in a flat panel display or the like in which the element needs to generate a relatively small current. When the electron emitting element is used as a power switching element operating by utilizing the high insulating property of a vacuum, however, a large current flows in the resistor layer, causing a great power loss.

If the electron emitting element is incorporated in a flat panel display or the like, the anode voltage can remain much higher than the gate voltage, and most of the electrons emitted from the emitters move toward the anode electrode. If the electron emitting element is used as a switching element, however, the anode voltage falls to almost the gate voltage when the element is switched on. In this case, an excessive current flows in the gate electrode, possibly breaking down the element, since the resistor layer provided near the emitters does not serve to prevent the breakdown of the element.

If the conventional electron emitting element is used in a switching circuit and operated in its linear region, the gate current will be as large as the anode current when the element is switched on. Consequently, a large power loss will occur in the gate electrode for controlling the switching.

Furthermore, the excessive gate current is likely to break down the element as a whole.

As describe above, if the electron emitting element of field-emission type is used as a switching element, a large power loss will occur in the gate electrode, and an excessive current will flow in the gate electrode, possibly breaking down the element as a whole.

If the electron emitting element, which has a resistor layer, is used as a switching element, a large power loss will occur in the resistor layer, because the resistor layer is provided near the emitters. When the element is switched on, the anode voltage falls to almost the gate voltage, whereby an excessive current flows in the gate electrode, possibly breaking down the element.

BRIEF SUMMARY OF THE INVENTION

The object of the present invention is to provide an electron emitting device in which a power loss in the gate electrode is small and which would not be broken down when it is switched on, even if an excessive current flows in the gate electrode as the anode voltage falls to almost the gate voltage, and also to provide a switching circuit using the electron emitting device.

According to a first aspect of the invention, there is provided an electron emitting device which comprises: an emitter electrode for emitting electrons when applied with an electric field; a gate electrode for extracting the electrons emitted from the emitter electrode, when applied with a voltage from a signal source, the voltage being positive with respect to the emitter electrode; an anode electrode connected to a load, for collecting the electrons extracted by the gate electrode, and for passing an anode current; and a gate resistor connected between the signal source and the gate electrode, for reducing a gate current flowing in the gate electrode, without changing an anode current flowing in the anode, and for lowering a gate voltage by utilizing a voltage drop cause by the gate current.

According to a second aspect of the invention, there is provided an electron emitting device of the type described above, wherein the emitter electrode has a plurality of emitter elements arranged in a two-dimensional plane, the gate electrode has a plurality of gate elements, each provided for at least one emitter element, and the gate resistor has a plurality of resistor elements connected between the gate elements and the signal source.

A preferred mode of the electron emitting device of the invention is as follows:

(1) The emitter electrode or emitter elements are conical or pyramidal.

(2) A vacuum is maintained in the space between the anode electrode and the emitter electrode or emitter elements.

According to a third aspect of the invention, there is provided an electron emitting device of the type described above, wherein the emitter electrode, the gate electrode and the gate resistor are formed together on a substrate.

According to a fourth aspect of the invention, there is provided a switching circuit which comprises: an electron emitting device comprising an emitter electrode for emitting electrons when applied with an electric field, a gate electrode for extracting the electrons emitted from the emitter electrode, an anode electrode for collecting the electrons extracted by the gate electrode; a first voltage source for applying a voltage to the gate electrode, the voltage being positive with respect to the emitter electrode; a gate resistor connected in series between the first signal source and the gate electrode, for reducing a gate current flowing in the gate electrode, without changing an anode current flowing in the anode, and for lowering a gate voltage by utilizing a voltage drop cause by the gate current; a second voltage source for applying a positive voltage higher than the gate voltage to the anode electrode; and a load connected in series to the second voltage source.

A preferred mode of the switching circuit of the invention is as follows:

(1) The emitter electrode is conical or pyramidal.

(2) A vacuum is maintained in the space between the anode electrode and the emitter electrode.

(3) The gate resistor is made of a low-melting metal.

According to a fifth aspect of the invention, the re is provided an electron emitting device which comprises: a first conductive layer formed on a substrate and having a plurality of projecting emitters; an insulating layer provided on the first conductive layer and covering the first conductive layer, except tips of the projecting emitters; and a second conductive layer covering the insulating layer and having openings over the tips of the emitters. The second conductive layer includes a plurality of gate electrodes made thick around the emitters, respectively, a gate wire layer made thick, surrounding the emitters and spaced from the gate electrodes by a predetermined distance, and resistor layers interposed between the gate electrodes and the gate wire layer and made thinner than the gate electrodes and the gate wire layer.

According to the present invention, the voltage applied between the emitter electrode and the gate electrode is a little higher than an ideal voltage in the case a gate resistor is connected between the gate electrode and the signal source. This is because a gate current flows when a voltage higher than the ideal voltage is applied between the emitter electrode and the gate electrode. A current flows in the gate resistor at the same time the gate current flows. A voltage drop occurs also in the gate resistor. The voltage drop decreases the voltage applied between the emitter electrode and the gate electrode. If the voltage drop is excessive, the voltage applied between the emitter electrode and the gate electrode falls below the ideal voltage. In this case, no gate current flows, and a voltage drop no longer occurs in the gate resistor.

The voltage drop in the gate resistor balances with the emitter-gate voltage at a voltage that is a little higher than the ideal voltage. The current flowing in the gate electrode while the voltage drop remains balanced with the emitter-gate voltage is small. Therefore, the power loss in the gate electrode is much less than in the case where no gate resistor is provided.

Since the gate current is much smaller than in the case where no gate resistor is provided, no excessively large current flows in the gate electrode. This prevents breakdown of the electron emitting element.

In the electron emitting element of the present invention, a resistor layer is provided near the gate electrodes in which a current scarcely flows during the normal operation, and the gate electrodes are connected to one another by the resistor layer. Therefore, the power loss in the resistor layer can be minimized, and the array of emitters would not stop operating even if some of the emitters are short-circuited.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Embodiments of the present invention will be described, with reference to the accompanying drawings.

Figure 1:
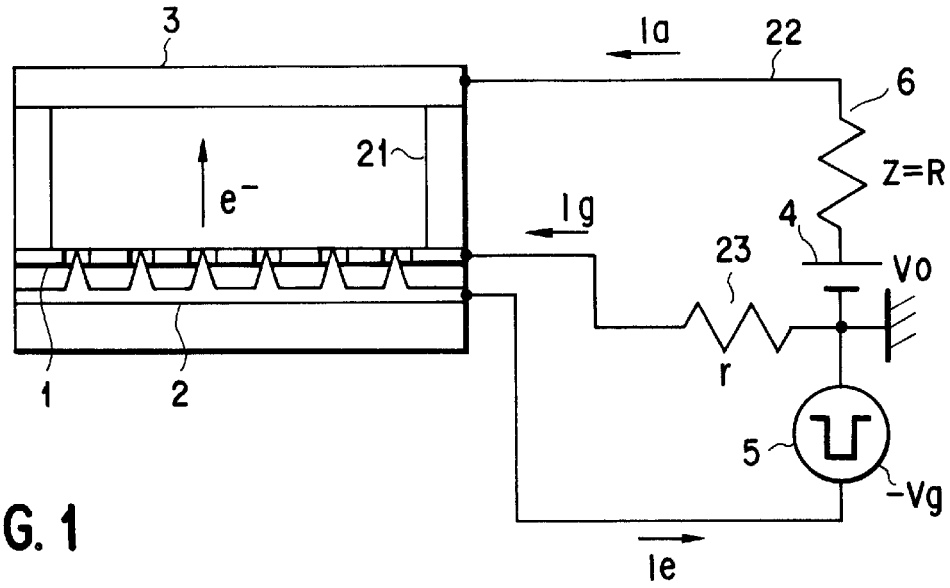
FIG. 1 is a diagram showing a switching circuit using an electron emitting element according to a first embodiment of the invention.

FIG. 1 shows a switching circuit using an electron emitting device according to the first embodiment of the invention. As FIG. 1 shows, the electron emitting element comprises a gate electrode 1, a plurality of conical emitters 2, an anode electrode 3, and a spacer 21. The anode electrode 3 is located above the gate electrode 1 and conical emitters 2, spaced therefrom by the spacer 21. The interior of the electron emitting element is sealed and maintained in a vacuum.

Figure 2:
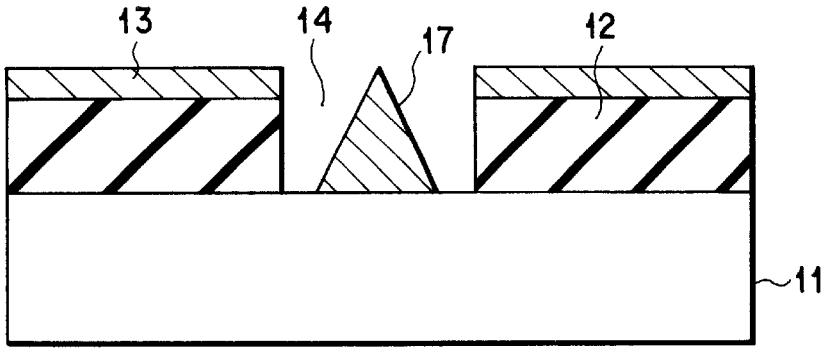
FIG. 2 is a sectional view showing one of the identical gate-emitter units provided in the electron emitting element shown in FIG. 1.

FIG. 2 is a sectional view showing one of the identical gate-emitter units of the electron emitting device of FIG. 1. As shown in FIG. 2, a $SiO_2$ layer 12 is provided on a selected part of an Si (silicon) single crystal substrate 11. An gate layer 13 is formed on the $SiO_2$ layer 12. A conical emitter 17 is formed on that part of the substrate 11 on which the $SiO_2$ layer 12 is not provided. The gate-emitter units of the type shown in FIG. 2 are arranged, forming an array which is a major section of the electron emitting element shown in FIG. 1.

As is shown in FIG. 1, wires 22 extend from the gate electrode 1, conical emitters 2 and anode electrode 3. The gate electrode 1 is connected to the ground by a resistor 23 having resistance r. The emitters 2 are connected to a signal source 5, which is connected to the ground. The signal source 5 generates a negative pulse voltage $-V_{gl}$. By virtue of the pulse voltage, a voltage is applied between the gate electrode 1 and the emitters 2, whereby electrons are emitted from the tips of the emitters 2 toward the gate electrode 1. As long as the signal source 5 keeps generating a pulse voltage, the switching circuit of FIG. 1 remains on. Thus, the switching circuit remains off while the signal source 5 is generating no pulse voltage at all.

The anode electrode 3 is connected to a load 6 having an impedance Z, which is connected to a voltage source 4 generating a voltage $V_0$. (For the sake of simplicity, the load 6 is represented as a resistor R in FIG. 1.) In the switching circuit thus structured, the electrons emitted from the emitters 2 move toward the gate electrode, and further toward the anode electrode 3 due to the voltage $V_0$ generated by the voltage source 4.

The operation of the switching circuit shown in FIG. 1 will be explained.

The signal source 5 applies a negative pulse voltage $V_{gl}$ between the gate electrode 1 and the emitters 2. An intense electric field is thereby generated at the tips of the conical emitters 2. Due to the electric field, electrons are emitted from the emitters 2 into a vacuum.

In the meantime, a voltage $V_0$ is applied to the anode electrode 3 from the voltage source 4 through the load 6. The voltage $V_0$ is higher than the voltage applied to the gate electrode 2. As the voltage $V_0$ is applied to the anode electrode 3, the electrons in the vacuum move from the vicinity of the gate electrode toward the anode electrode 3. The electrons are collected at the anode electrode 3.

The number of electrons emitted from the emitters 2 is determined by only the intensity of the electric field generated at the tips of the emitters 2. Since the anode electrode 3 are spaced much more from the emitters 2 than the gate electrode 1, the number of emitted electrons, i.e., current is determined by a gate voltage. The electrons emitted when the gate voltage is low move mostly toward the gate electrode 1, and few electrons reach the anode electrode 3. As the anode voltage increases, the number of electrons moving toward the gate electrode 1 decreases, and the number of electrons reaching the anode electrode 3 increases. When the anode voltage increases to a sufficient value, all electrons emitted from the emitters 2 reach the anode electrode 3.

Figure 3:
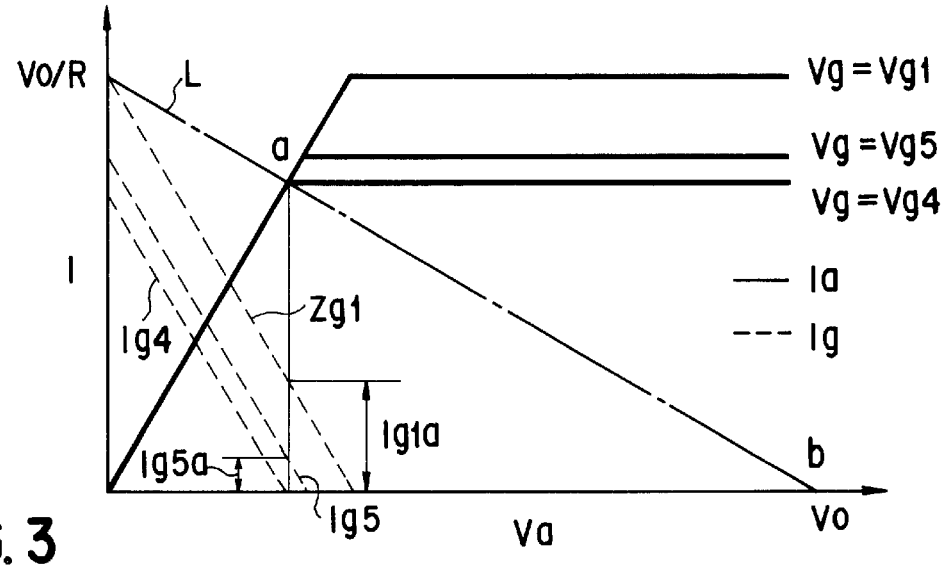
FIG. 3 is a graph representing the V-I characteristic of the load to the switching circuit shown in FIG. 1.

FIG. 3 represents the V-I characteristic of the load to the switching circuit of FIG. 1. In FIG. 3, current and voltage are plotted on the abscissa and ordinate, respectively. The solid line indicates the anode current $I_a$ the one-dot, dashed line is a load line, and the broken lines indicate the gate currents $I_g$. The load line depicts a relation $V_a=V_0-RI_a$, where $V_a$ is the voltage between the gate 1 and the anode electrode 3.

If the resistor 23 were not provided, the operating point of the circuit would be at the intersection of the V-I characteristic curve and the load line. Thus, the switching circuit would on at point a, and is off at point b. As can be understood from the line indicating how the gate current Ig1 changes when a voltage Vg1 is applied to the gate electrode 1, a current $I_{gla}$ flows in the gate electrode 1 while the switching circuit remains on. In this case, a large power loss $I_{gla} \times V_{gl}$ occurs at the gate electrode 1.

The gate voltage ideal for the switching circuit is $V_{g4}$, so that the circuit remains on at the boundary between the linear region and the saturation region. This is because a power loss will take place at the gate electrode 1 if the gate voltage is higher than $V_{g4}$, increasing the gate current $I_g$ as the broken line shows. If the gate voltage is lower than $V_{g4}$, the circuit will be on in the saturation region, inevitably increasing the on voltage. It is practically difficult to change the gate voltage in accordance with the load 6. Moreover, the electron emitting element may have characteristics different from the design characteristics.

This is why the resistor 23 is incorporated in the switching circuit, enabling the electron emitting element to operate in the most desirable manner possible. Thanks to the resistor 23, the voltage applied between the gate electrode 1 and the conical emitters 2 is $V_{g5}$ which is a little higher than the ideal value $V_{g4}$. This is because the gate current $I_{g1}$ flows when the voltage $V_{g1}$ much higher than the ideal voltage $V_{g4}$ is applied between the gate electrode 1 and the conical emitters 2. Hence, a current flows in the resistor 23, too, and a voltage drop occurs in the resistor 23. This voltage drop results in a decrease in the voltage applied between the gate electrode 1 and the emitters 2. If the voltage drop in the resistor 23 is too large, the voltage between the gate electrode 1 and the emitters 2 falls blow the voltage $V_{g4}$, and the gate current $I_g$ ceases to flow. A voltage drop no longer takes place in the resistor 23. As a result, the V-I characteristic curve shifts upward from the position of the characteristic curve for the ideal emitter-gate voltage $V_{g4}$.

Hence, the voltage drop in the resistor 23 balances with the emitter-gate voltage, at the emitter voltage $V_{g5}$ which makes a small gate current $I_{g5a}$ flow and which is a little higher than the emitter-gate voltage $V_{g4}$. At this time, the power loss in the gate electrode 1 is $I_{g5} \times V_{g5}$. Since $I_{g5a} << I_{g1a}$ and $V_{g5} < V_{g1}$, the power loss is much smaller than the power loss which should occur if the resistor 23 were not used.

The gate current $I_{g5a}$ can be made much smaller than the current $I_{g1a}$. The gate current $I_g$ can therefore be reduced, in order to prevent the breakdown of the electron emitting element.

The switching circuit operates, essentially in the same way as described above, even if the operating characteristics of the electron emitting element differ from the design characteristics. Since the voltage drop in the resistor 23 balances with the emitter-gate voltage, at the voltage $V_{g5}$ which is a little higher than the emitter-gate voltage $V_{g4}$, the electron emitting element can operate reliably. Once the gate current Ig5 is set at a specific value, the resistance r of the resistor 23 can be set at a value greater than $(V_{gl}-V_{th})/I_{g5a}$, where $V_{th}$ is the gate voltage at which the emitters 2 start emitting electrons. If the resistor r is too high, however, the speed of the switching circuit will decrease due to the emitter-gate capacitance. It is therefore desired that the resistance r be as low as possible.

Since the resistor 23 is connected between the gate electrode 1 and the signal source 5 as mentioned above, the power loss in the gate electrode 1 decreases and no excessive current flows in the gate electrode 1. Hence, the electron emitting element would not be broken down.

As shown in FIG. 1, the signal source 5 is connected to the wire 22 extending from the emitters 2. Instead, the signal source 5 may be connected to the wire 22 that extends from the gate electrode 1 and may be connected in series to the resistor 23. If so, the present invention works as well.

Figure 4A:
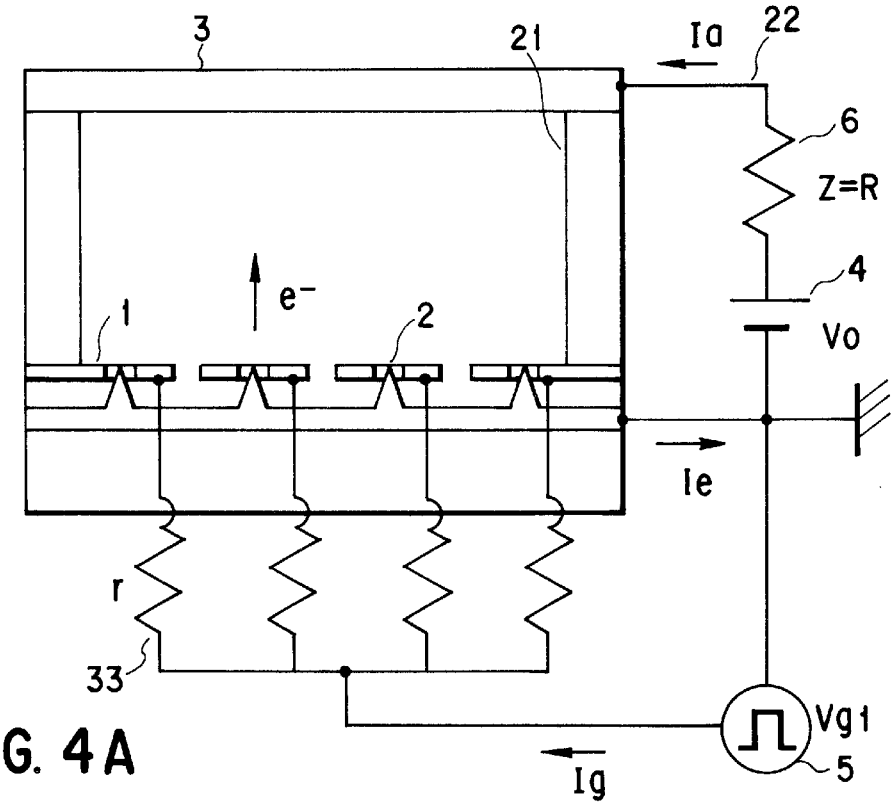
FIG. 4A is a diagram illustrating a switching circuit using an electron emitting element according to a second embodiment of the invention.

FIG. 4A illustrates a switching circuit using an electron emitting element according to a second embodiment of the invention. The components identical to those shown in FIG. 1 are designated at the same reference numerals in FIG. 4A and will not be described in detail.

As shown in FIG. 4A, the electron emitting device according to the second embodiment comprises a gate electrode 1, a plurality of conical emitters 2, an anode electrode 3, and a spacer 21. The anode electrode 3 is located above the gate electrode 1 and conical emitters 2, spaced therefrom by the spacer 21. The interior of the electron emitting element is sealed and maintained in a vacuum. As far as these structural features are concerned, the second embodiment is identical to the first embodiment.

Figure 4B:
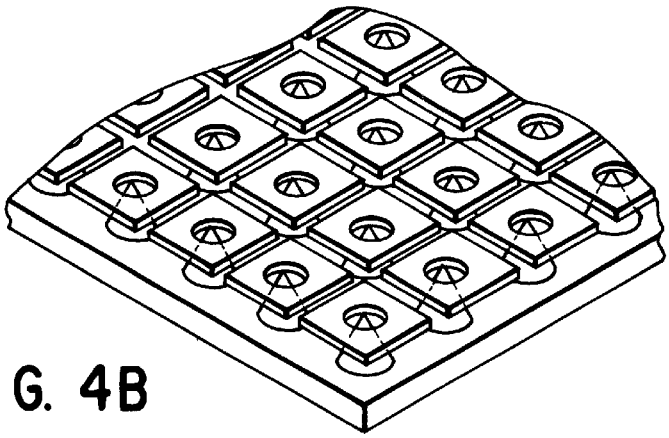
FIG. 4B is a perspective view of a part of a modification of the second embodiment.
Figure 4C:
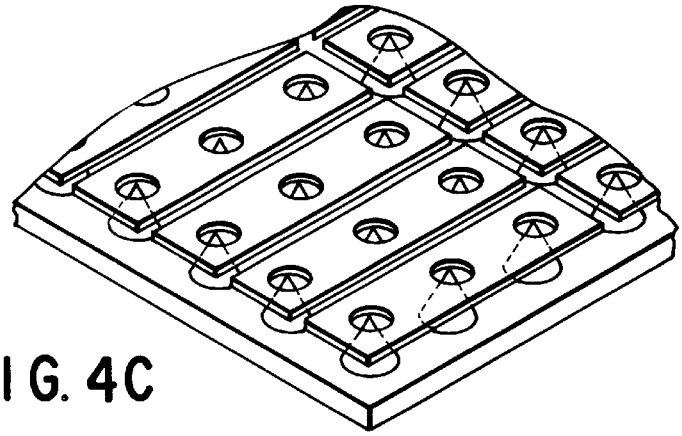
FIG. 4C is a perspective view of a part of another modification of the second embodiment.

The second embodiment is characterized in that the gate electrode 1 is divided into a plurality of electrodes, each for one conical emitter 2 as shown in FIG. 4B, or each for a prescribed number of emitters (for example, 100 to 1000 emitters) as shown in FIG. 4C. A plurality of wires 22 extends from gate electrodes 1, one from each gate electrode 1. A plurality of resistors 33 are connected to the wires 22, one to each wire 22. The resistors 33 are connected to one signal source 5.

Since the gate electrodes 1 are provided, each for one conical emitter 2 or for the prescribed number of emitters 2, the conical emitters 2 can be independently controlled so as to emit electrons in the same manner even if they differ in operating characteristics.

The resistors 33 may be formed by semiconductor microfabrication technique on the same substrate as the electrodes 1 and emitters 2 are provided. In the second embodiment, the emitters 2 are connected to the ground, and positive voltages are applied to the gate electrodes 1. The resistors 33 can be made of low-melting metal or the like so that they may be cut like fuses when an excessive current $I_g$ flows through them.

The operation of the switching circuit shown in FIGS. 4A to 4C, which incorporates the electron emitting element according to the second embodiment, will be explained.

When the signal source 5 supplies a pulse voltage to the electron emitting element, a positive voltage is applied between the gate electrodes 1 and the emitters 2. An intense electric field is thereby generated at the tips of the conical emitters 2. Due to the electric field, electrons are emitted from the emitters 2 into a vacuum.

In the meantime, a voltage $V_0$ is applied to the anode electrode 3 from the voltage source 4 through the load 6. The voltage $V_0$ is a positive voltage higher than the voltage applied to the gate electrodes 2. As the voltage $V_0$ is applied to the anode electrode 3, the electrons in the vacuum move from the vicinity of the gate electrodes 1 toward the anode electrode 3. The electrons are collected at the anode electrode 3.

The number of electrons emitted from the emitters 2 is determined by only the intensity of the electric field generated at the tips of the emitters. 2. Since the anode electrode 3 are spaced much more from the emitters 2 than the gate electrode 1, so that the number of the emitted electrons, i.e., current is determined only by the gate voltage. When the anode voltage is low, the electrons emitted move mostly toward the gate electrode 1, and no electron reaches the anode electrode 3. As the anode voltage increases, the number of electrons moving toward the gate electrodes 1 decreases, and the number of electrons reaching the anode electrode 3 increases. When the anode voltage increases to a sufficient value, all electrons emitted from the conical emitters 2 reach the anode electrode 3.

In the second embodiment, each resistor 33 is provided for one conical emitter 2 or a prescribed number of conical emitters 2. This achieves an almost ideal state. In the second embodiment having the resistors 33, the voltage applied between the gate electrodes 1 and the emitters 2 is $V_{g5}$ as in the first embodiment. (Voltage $V_{g5}$ is slightly higher than the ideal voltage $V_{g4}$.)

The switching circuit shown in FIGS. 4A to 4C operates, essentially in the same way as described above, even if the operating characteristics of the electron emitting element differ from the design characteristics. This is because the operation is effected in units of conical emitters 2 or in units of groups of emitters 2. That is, even if the conical emitters 2 have different characteristic curves, the switching circuit will operate on the basis of their characteristics curves, thanks to the resistors 33 provided for the emitters 2. For each emitter 2, the voltage drop in the associated resistor 33 balances with the emitter-gate voltage at a voltage $V_g$ that is a little higher than the ideal voltage $V_{g4}$. The electron emitting element can therefore operate reliably.

Since the resistors 33 are connected between the gate electrodes 1 and the signal source 5, the power loss in the gate electrodes 1 decreases and no excessive current flows in the gate electrodes 1. Hence, the electron emitting element would not be broken down.

As described above, each resistor 33 is provided for one emitter 2 or for a prescribed number of emitters 2 and is connected between the emitter or emitters 2 and the signal source 5. Thus, even if the conical emitters 2 differ in operating characteristic, the current flowing in the gate electrode 1 associated with each emitter 2 or a prescribed number of emitter 2 can be decreased. Therefore, the power loss in the gate electrode 1 can be reduced and the breakdown of the electron emitting element can be prevented.

In the first embodiment, the resistor 23 is connected to the wire 22 extending from the electron emitting element. Similarly, in the second embodiment, the resistors 33 are connected to wires extending from the electron emitting element. Nonetheless, the resistor 23 and resistors 33 may be formed on the same substrate as the electrode or electrodes 1 and conical emitters 2 are provided. Moreover, various changes and modifications can be made, without departing from the scope and spirit of the present invention.

The first embodiment incorporates the resistor 23 which causes the electron emitting element to operate in the most desirable manner possible. Similarly, the second embodiment incorporates the resistors 33 which cause the electron emitting element to operate in the most desirable manner possible. According to this invention, a gain control may be used in place of a resistor or resistors.

Figure 5:
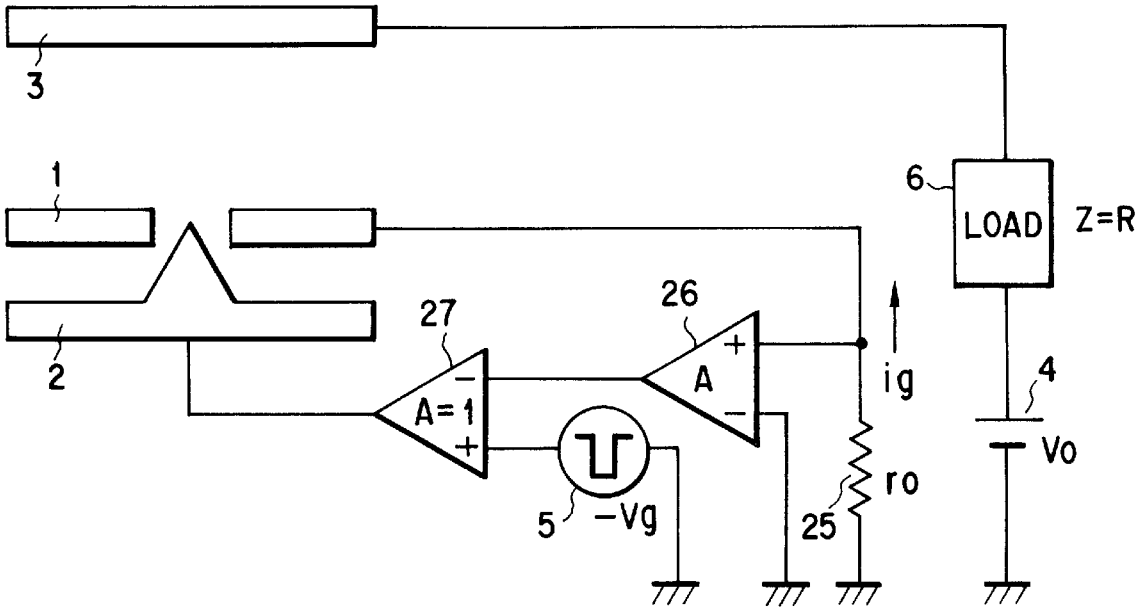
FIG. 5 is a diagram showing a switching circuit using an electron emitting element according to a third embodiment of the invention.

FIG. 5 shows a switching circuit using an electron emitting element according to the third embodiment of the invention. The third embodiment can achieve the same advantage as the first and second embodiments. As shown in FIG. 5, the third embodiment comprises a gate electrode 1, a conical emitter 1, an anode electrode 3, a signal source 5, a resistor 25, and two differential amplifiers 26 and 27. The resistor 25, which has resistance r0, is connected between the gate electrode 1 and the ground. The differential amplifier 26 is provided to detect the current ig flowing in the resistor 25. The non-inverting input of the amplifier 26 is connected to the node of the gate electrode 1 and the resistor 25. The output of the signal source 5 and the output of the differential amplifier 26 are connected to the inverting input and non-inverting input of the differential amplifier 27, respectively. The output of the differential amplifier 27 is connected to the conical emitter 2.

The resistor 25 and the differential amplifier 26 detect the current ig flowing in the gate electrode 1. The amplifier 26 generates a voltage signal corresponding to the current ig. The voltage signal is supplied to the differential amplifier 27. The voltage signal corresponds to the current ig. The amplifier 27 applies a voltage to the emitter 2. This voltage is given as: $-Vg+A\cdot rO\cdot ig=-(Vg-A\cdot rO\cdot ig)$, where A is the amplification factor. The voltage applied between the gate electrode 1 and the conical emitter 2 can therefore approach the ideal value that would enable the electron emitting element to perform its function reliably.

With reference to FIGS. 6A to 6I, a method of manufacturing an electron emitting element according to the fourth embodiment will be explained. The fourth embodiment is a semiconductor device which is a combination of the second embodiment and resistors.

Figure 6A:
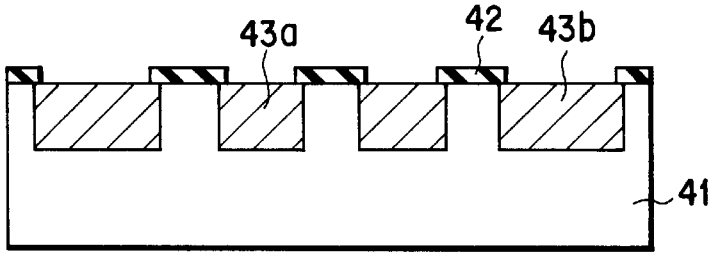
FIGS. 6A to 6I are sectional views for explaining a method of manufacturing an electron emitting element according to a fourth embodiment of the invention.

First, as shown in FIG. 6A, a p-type Si substrate 41 of (100) crystal orientation is prepared. Then, a $SiO_2$ film 42 is formed on the Si substrate 41 by means of dry oxidation. The resultant structure is placed on a turntable known as "spinner." While the structure is rotated at high speed, resist liquid is dripped onto the $SiO_2$ film 42. The resist liquid spreads over the film 42 by virtue of the centrifugal force. The solvent is evaporated from the resist liquid, forming a resist on the $SiO_2$ film 42. Further, photolithography, exposure, and development are performed, thereby patterning the resist. Using the resist, thus pattered, is used as a mask, NH4F/HF mixture aqueous solution is applied, performing selective etching on the $SiO_2$ film 42 and exposing parts of the Si substrate 41. In other words, a plurality of openings is made in the $SiO_2$ film 42.

Figure 7A:
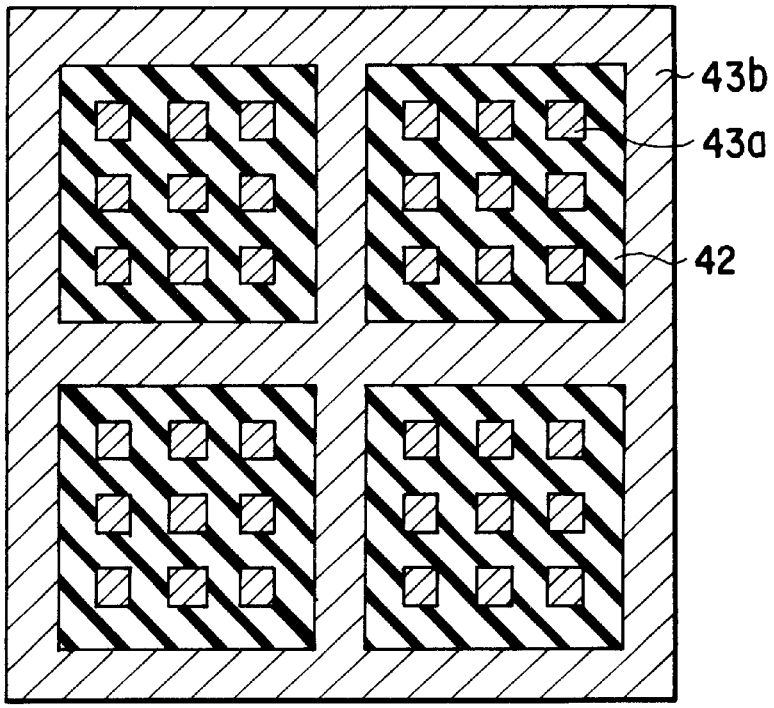
FIGS. 7A and 7B are plan views of the electron emitting element according to the fourth embodiment.

Next, P (phosphorus), for example, is ion-implanted into the Si substrate through the openings of the $SiO_2$ film 42. As a result, n-type regions 43 are formed in the surface of the Si substrate 41. The resultant structure as viewed from above appears as is shown in FIG. 7A. As seen from FIG. 7A, the n-type regions 43 include square regions 43*a* having a size of 4×4 μm and n-type regions 43*b*. The square n-type regions 43*a* will be gate electrodes. The n-type regions 43*b* will become gate wires.

Figure 6B:
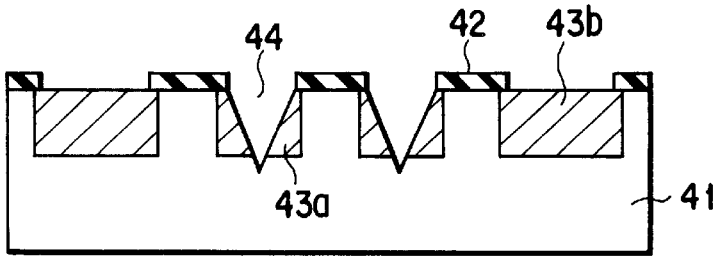

As shown in FIG. 6B, KOH aqueous solution is applied, conducting anisotropic etching on the structure shown in FIG. 6A, thereby forming an inverted conical recess 44 in each square n-type region 43*a* and partly in the Si substrate 41. The n-type regions 43*b* are not etched at all.

The above-mentioned selective etching is carried out in the following way. The electrochemical etching is conducted while by applying a reverse bias voltage to the pn junction, etching only the p-type part only, not etching the n-type part. In the fourth embodiment, a reverse bias voltage is applied between each n-type region 43*b* and the p-type part of the Si substrate 41. Applied with the reverse bias, the n-type region 43*b* is not etched at all. By contrast, each n-type region 43*a* is etched, because the region 43*a* is separated from the region 43*b* by a p-type part of the Si substrate 41 as shown in FIG. 7A and no reverse bias is therefore applied to the region 43*a*.

Figure 6C:
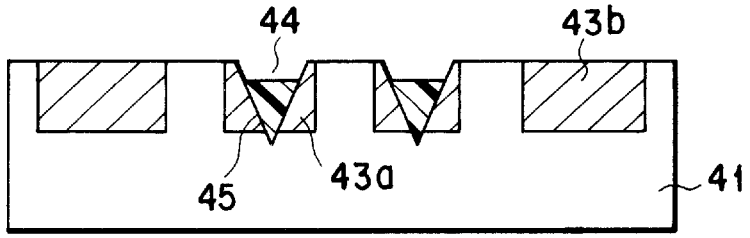

Then, a resist is spin-coated on the surface of the Si substrate 41 processed as shown in FIG. 6C. The resist is etched back, leaving a resist 45 in each recess 44 only. The $SiO_2$ film 42 is then removed, thereby obtaining the structure shown in FIG. 6C.

Figure 6D:
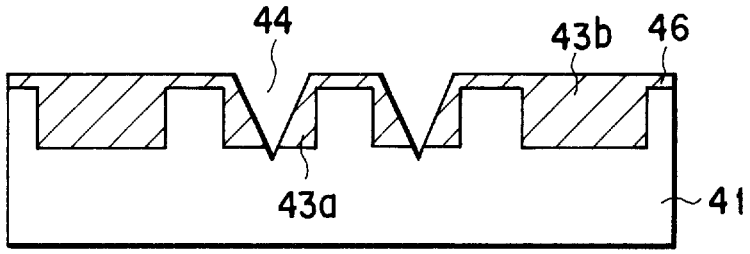

Further, P (phosphorus), for example, is ion-implanted, forming a shallow and low impurity concentration n-type region in the surface of the Si substrate 41 as is illustrated in FIG. 6D. The shallow n-type region functions as a resistor layer 46. The resists 45 work as a mask during the ion implantation. Therefore, the P ions are not injected into the recesses 44; they are implanted into the Si substrate 41 only. After the ion implantation, the resists 45 are removed.

Figure 6E:
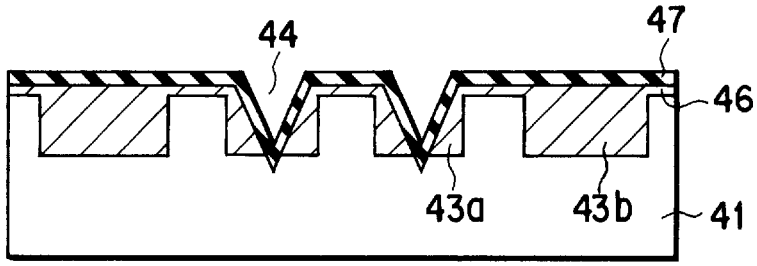

Next, wet oxidation is performed on the structure of FIG. 6D. As a result, an $SiO_2$ film 47 having a predetermined thickness is formed on the surface of the Si substrate 41 and also in the recesses 44, as is illustrated in FIG. 6E.

Figure 6F:
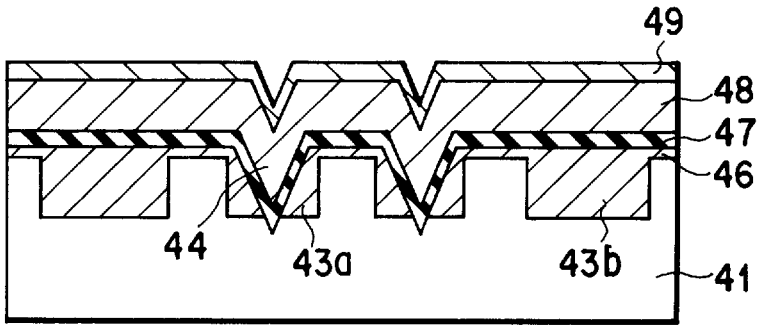

As shown in FIG. 6F, emitter material such as Mo or similar metal is deposited on the $SiO_2$ film 47, forming an emitter layer 48. Further, an adhesion layer 49 made of Al or the like is formed on the emitter layer 48. The layer 49 is provided to accomplish electrostatic bonding.

Figure 6G:
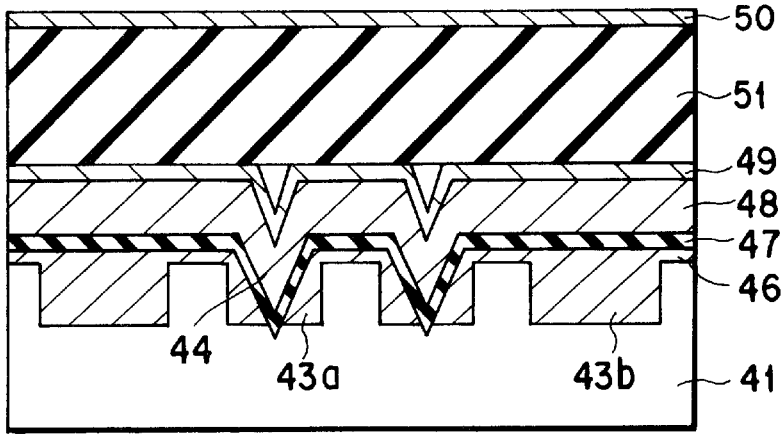

Then, as shown in FIG. 6G, a glass substrate 51 is prepared. The glass substrate 51 has an Al layer 50 provided on one surface. The glass plate 51 is placed on the adhesion layer 49, with the Al layer 50 facing away from the adhesion layer 49. A high voltage is applied between the adhesion layer 49 and the Al layer 50 at high temperature, thereby conducting electrostatic adhesion. Upon completion of the electrostatic adhesion, the Al layer 50 is removed.

Figure 6H:
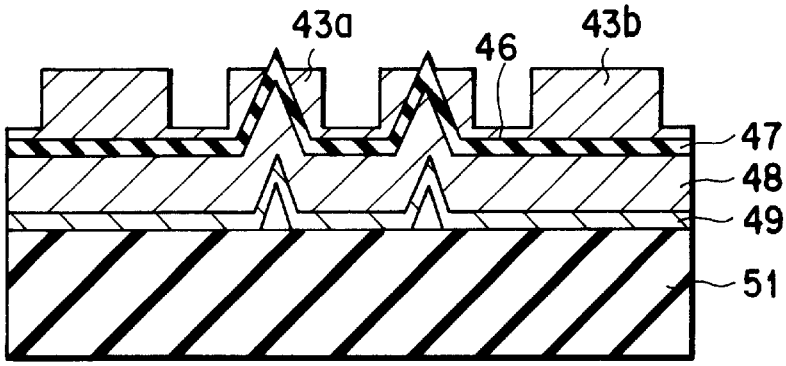

Then, electrochemical etching is performed, removing the p-type parts of the Si substrate 41. As shown in FIG. 6H, the structure of FIG. 6G is turned upside down.

Figure 6I:
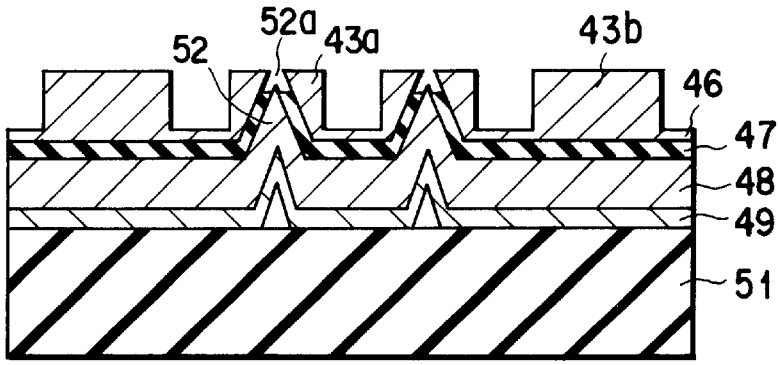

As illustrated in FIG. 6I, those parts of the $SiO_2$ film 47 which covers the tips of emitters 52 are removed by etching. As a result, an electron emitting element is manufactured which is the fourth embodiment of the present invention.

As mentioned above, the electron emitting element thus manufactured, i.e., the fourth embodiment, is a semiconductor device which is a combination of the electron emitting element and the resistors 33, all shown in FIG. 4A. The fourth embodiment will be described in detail, in connection with the switching circuit shown in FIG. 4A.

In the element of FIG. 6I, each n-type region 43*a* surrounding one emitter 52 is thick and therefore has low resistance. The n-type region 43*a* corresponds to one of the gate electrodes 1 shown in FIG. 4A. The n-type regions 43*a* are separated from one another and provided on the resistor layer 46, which is thin, low impurity concentration and therefore has high resistance. Those parts of the resistor layer 46 which surround the n-type regions 43*a* correspond to the resistors 33 shown in FIG. 4A. The layers 46, or resistors, are connected to the emitters 52, respectively, as in the switching circuit of FIG. 4A.

The n-type regions 43*b*, being thin and having low resistance, work as gate wires for applying voltages to the n-type regions 43*a* through the resistor layer 46. Hence, the electron emitting element can keep operating even if some emitters 52 are short-circuited with the gate electrodes, as will be explained below with reference to FIG. 7B.

Figure 7B:
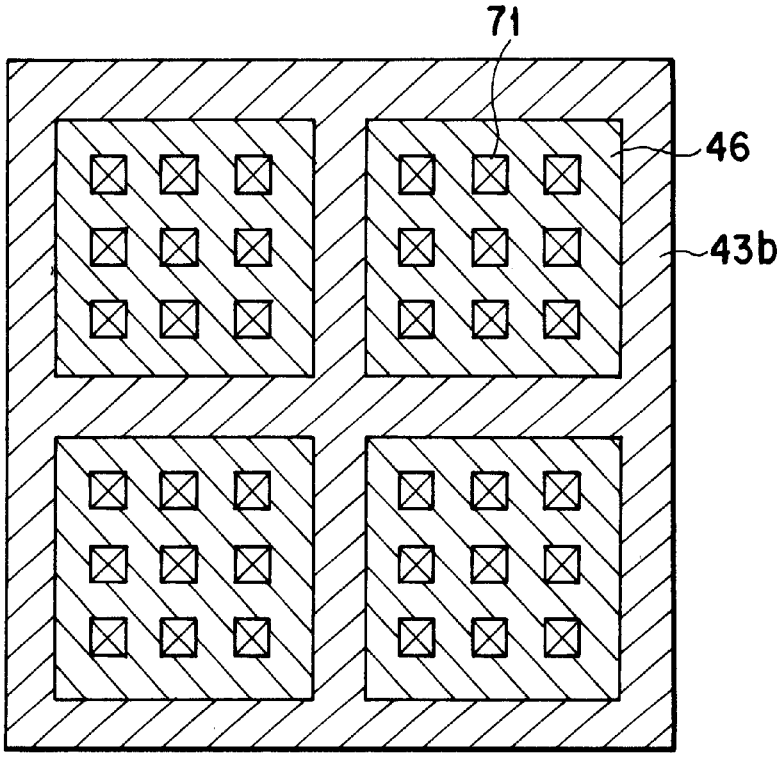

FIG. 7B is a plan view of the electron emitting element having the structure shown in FIG. 61. As seen from FIG. 7B, emitter gate electrodes 71 are surrounded by resistor layers 46 and connected by the resistor layers 46 to the n-type regions 43*b* which function as gate wires. In other words, resistors are connected to the emitter gate electrodes 71, connecting the emitter gate electrodes 71 to one another. This structure is advantageous. If some emitter gate electrodes 71 are short-circuited, their potential will become equal to that of the associated emitters 52. Nonetheless, the other emitter gate electrodes 71 adjacent to the short-circuited electrodes 71 have their potential not affected at all, thanks to the resistors connected to the emitter gate electrodes 71. The electron emitting element can therefore operate reliably.

When the electron emitting element according to the fourth embodiment is used as a switching element, it operates in the same way as the second embodiment. Hence, the power loss in the emitter gate electrodes 71 is reduced greatly while the element used as a switching element remains on, as in the electron emitting element according to the second embodiment. In addition, the electron emitting element would not be broken down. Further, the array of emitters 53 would not be disabled even if some of the emitters were short-circuited with the associated emitter gate electrodes 71.

In the fourth embodiment, the $SiO_2$ film 42 is formed by dry oxidation as indicated above. Instead, the $SiO_2$ film 42 may be formed by deposited by CVD method or the like. Furthermore, the emitters 52 may be made of emitter material such as LaB6, TiN or the like, instead of Mo (molybdenum).

With reference to FIGS. 8A to 8I, a method of manufacturing an electron emitting element according to the fifth embodiment will be explained. The components identical to those shown in FIGS. 6A to 6I are denoted at the same reference numerals in FIGS. 8A to 8I and will not be described in detail. The fifth embodiment differs from the fourth embodiment in that the gate wires are made of metal, not Si (silicon).

Figure 8A:
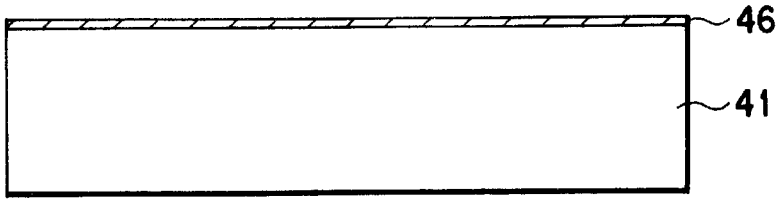
FIGS. 8A to 8I are sectional views for explaining a method of manufacturing an electron emitting element according to a fifth embodiment of the invention.

First, as shown in FIG. 8A, a resistor layer 46 is formed on a p-type Si substrate 41. Then, a $SiO_2$ film 42 is formed on the resistor layer 46 by means of thermal oxidation. The $SiO_2$ film 42 is patterned, whereby a plurality of openings are made in the $SiO_2$ film 42. P (phosphorus), for example, is ion-implanted into the Si substrate 41 through the openings of the $SiO_2$ film 42. As a result, n-type regions 43*a* are formed as shown in FIG. 8B, in those parts of the Si substrate 41 which are exposed through the openings of the $SiO_2$ film 42.

Figure 8B:
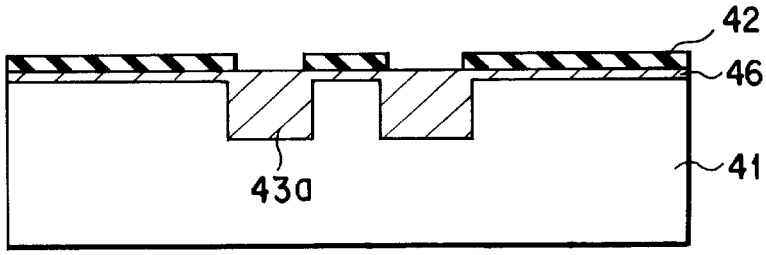
Figure 8C:
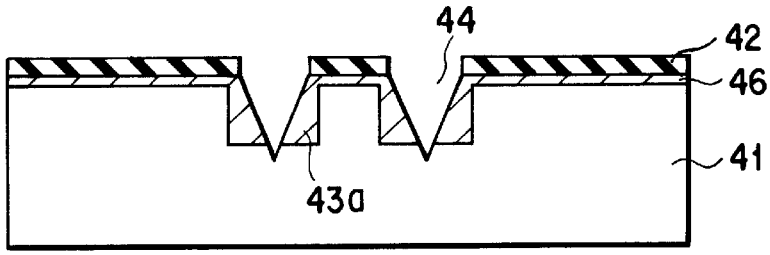
Figure 8D:
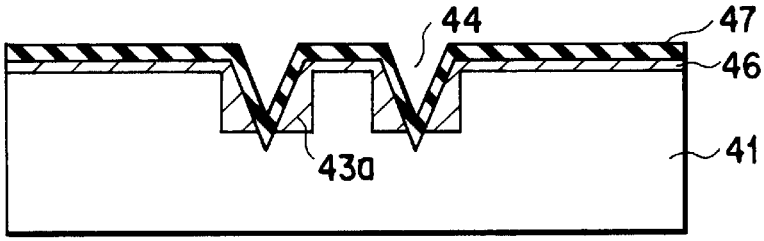

Next, etching is conducted on the structure shown in FIG. 8B, thereby forming an inverted conical recess 44 in each n-type region 43*a* and partly in the Si substrate 41 as shown in FIG. 8C. Further, an $SiO_2$ film 47 is deposited on the surface of the Si substrate 41 and also in the recesses 44, as is illustrated in FIG. 8D. Thereafter, an emitter layer 48, an adhesion layer 49, a glass substrate 51, and an Al layer 50 are formed in the same way as in the fourth embodiment, and the Si substrate 41 is then removed, as is illustrated in FIGS. 6E, 6F, 6G and 6H. The method of manufacturing the fifth embodiment differs from the method of manufacturing the fourth embodiment in two respects. First, the resistor layer 46 is formed before forming the recesses 44. Second, no n-type regions 43*b* are formed at all.

Figure 8E:
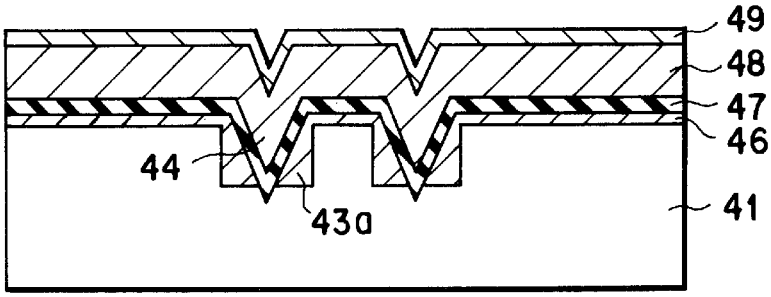
Figure 8F:
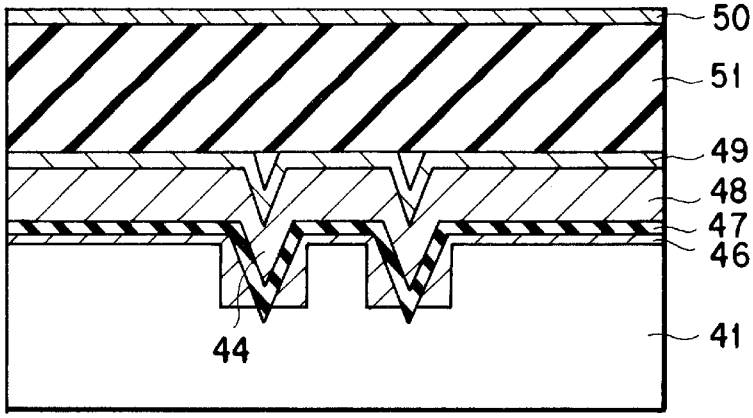
Figure 8G:
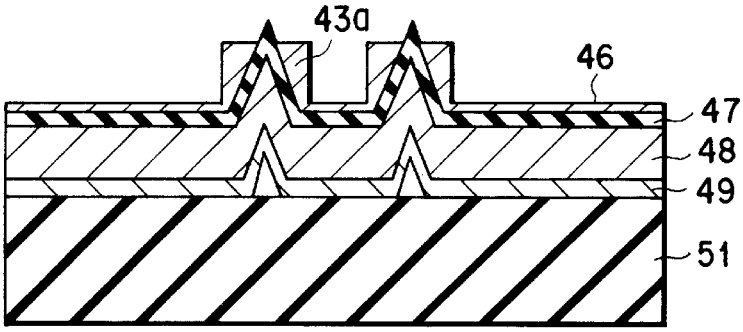
Figure 8H:
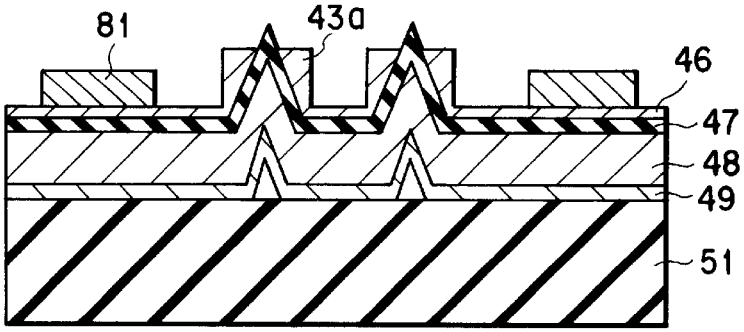

As shown in FIG. 8H, gate wires 81 made of, for example, Al are formed, not by processing the n-type regions 43*b* as in the fourth embodiment. More precisely, the wires 81 are formed by first depositing an Al film and then patterning the Al film. This is another characterizing feature of the fifth embodiment.

Figure 8I:
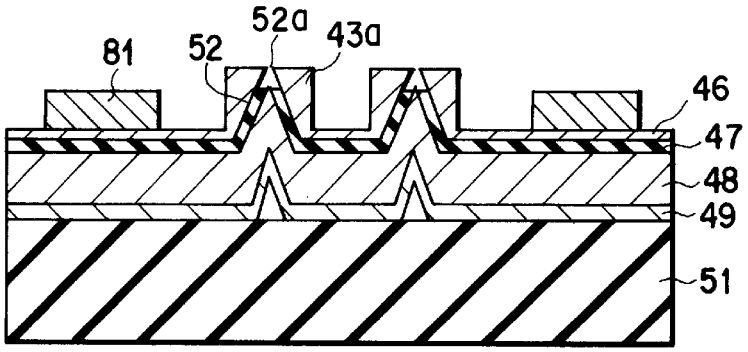

Thereafter, those parts of the $SiO_2$ film 47 which cover the tips of the conical emitters 52 ate removed as shown in FIG. 8I. The electron emitting element according to the fifth embodiment is thus manufactured.

When the fifth embodiment is used as a switching element, it operates in the same way as the fourth embodiment. As mentioned above, the fifth embodiment differs in that the gate wires 81 are made of metal such as Al, not by processing the n-type regions 43*b*. Therefore, the voltage drop in the gate wires 81 is less than in the fourth embodiment. In the fourth embodiment, where the electron emitting element of a large size is fabricated, the gate wires are formed by n-type region 43*b* made thick. In this case, a voltage drop not negligible occurs. However, if the gate wires 81 are formed by Al as the fifth embodiment, the voltage drop is decreased, the Al gate wires 81 are effective for the large size electron emitting element.

With reference to FIGS. 9A to 9I, a method of manufacturing an electron emitting element according to the sixth embodiment will be explained. The components identical to those shown in FIGS. 6A to 6I are denoted at the same reference numerals in FIGS. 9A to 9I and will not be described in detail. The sixth embodiment differs the fourth and fifth embodiments in that the gate electrodes, resistor layer and gate wires are made of metal, not Si (silicon).

Figure 9A:
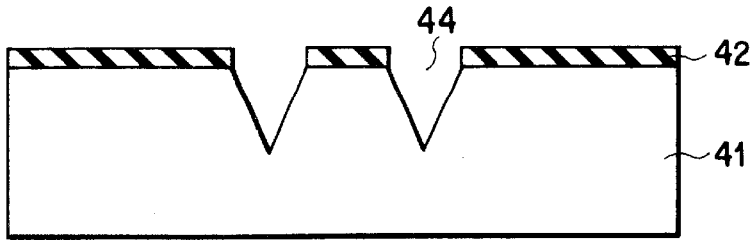
FIGS. 9A to 9I are sectional views for explaining a method of manufacturing an electron emitting element according to a sixth embodiment of the invention.
Figure 9B:
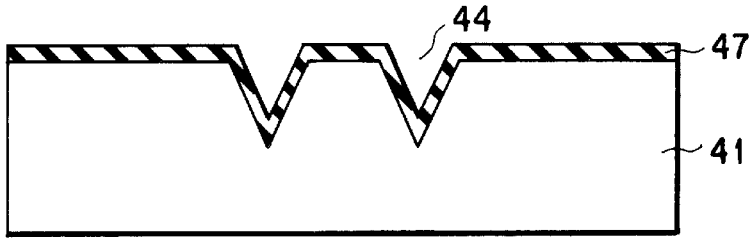
Figure 9C:
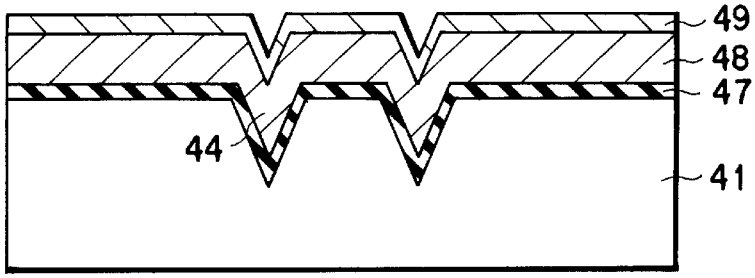
Figure 9D:
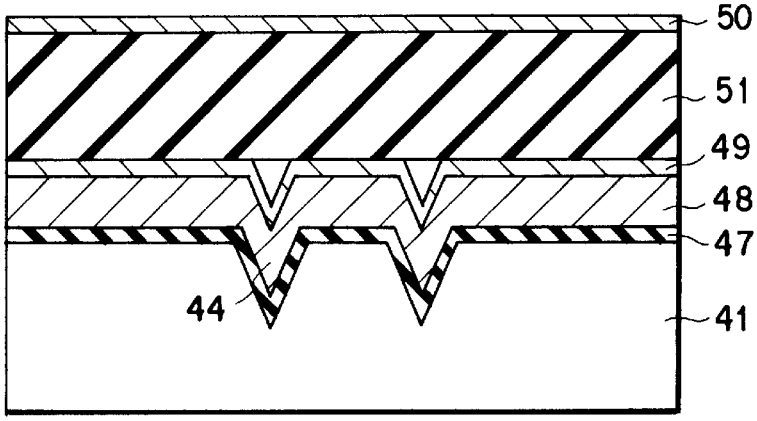
Figure 9E:
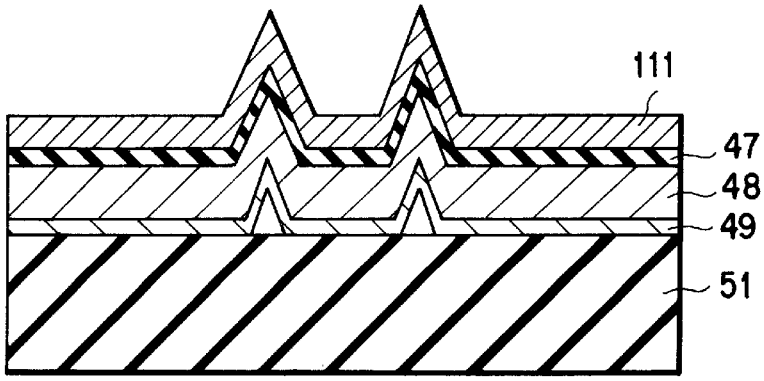

First, as shown in FIG. 9A, a $SiO_2$ film 42 is formed on a p-type Si substrate 41 by means of thermal oxidation. The $SiO_2$ film 42 is patterned, whereby a plurality of openings are made in the $SiO_2$ film 42. Etching is conducted on the substrate 41, forming inverted conical recesses 44 in the surface of the Si substrate 41. The $SiO_2$ film 42 is then removed, and an $SiO_2$ film 47 is deposited on the surface of the Si substrate 41 and also in the recesses 44, as is illustrated in FIG. 9B. Thereafter, as shown in FIGS. 9C and 9D, an emitter layer 48, an adhesion layer 49, a glass substrate 51, and an Al layer 50 are formed, one upon another, on the $SiO_2$ film 47, in the same way as in the fourth embodiment. As shown in FIG. 9E, the Si substrate 41 removed from the $SiO_2$ film 47.

Figure 9F:
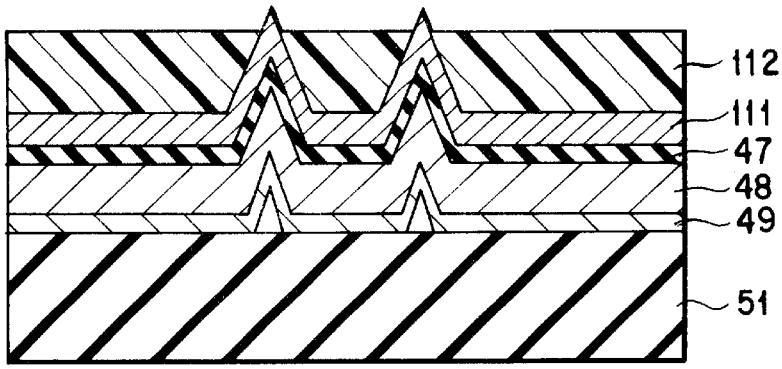

Next, a gate layer 111 made of a metal is formed, covering the $SiO_2$ film 47, as is illustrated in FIG. 9E. A resist 112 is spin-coated on the gate layer 111 and etched back until the peaks of the gate layer 111 are exposed, as is illustrated in FIG. 9F.

Figure 9G:
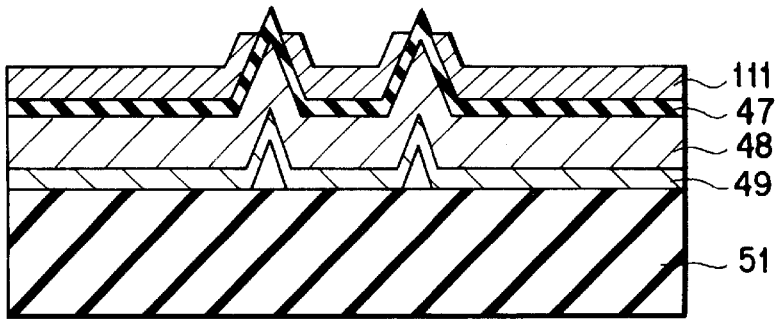

Then, the peaks of the gate layer 111 are removed, thus exposing the peaks of the $SiO_2$ film 47 and the resist 112 is removed, as is illustrated in FIG. 9G.

Figure 9H:
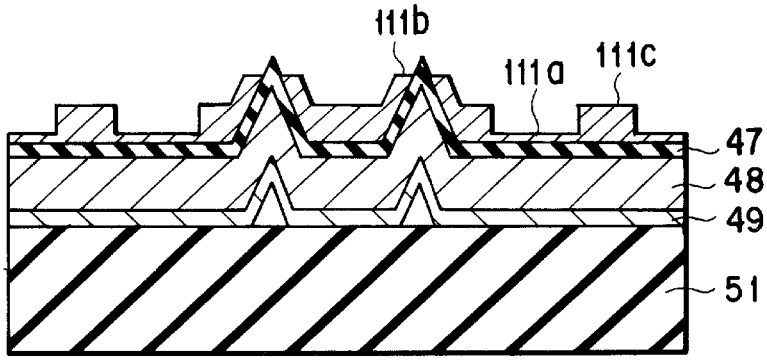
Figure 9I:
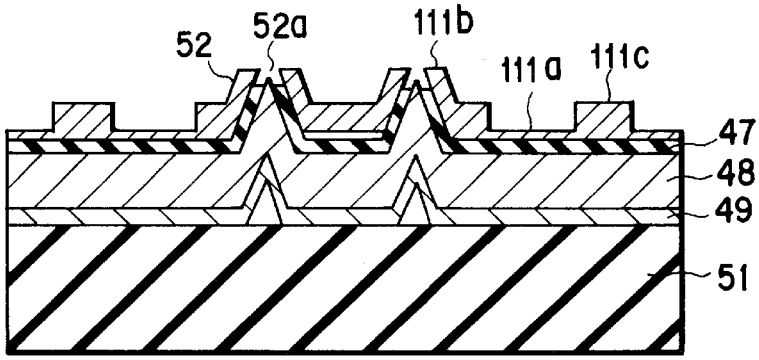

The gate layer 111 is patterned. To be more specific, parts of the layer 111 are etched away, forming resistor layers 111*a* as shown in FIG. 9H. The parts 111*b* of the resistor layer 111, which surround the peaks of the $SiO_2$ film 47, are used as gate electrodes, while the other parts 111*c* of the layer 111 function as gate wires.

The gate layer 111 may be patterned in a different manner. First, a high-resistance, thin metal layer is formed to be processed into resistor layers 111*a*. Then, a low-resistance thin metal layer is formed. Those parts of the low-resistance metal layer which contact the resistor layer 111*a* are etched and removed, whereby the remaining parts of the low-resistance metal layer are used as electrodes and wires. If the gate layer 111 so patterned, it will become easy to control the thickness of the resistor layers 111*a*.

Next, those parts of the $SiO_2$ film 47 which surround the tips 52*a* of the conical emitters 52 are removed by etching, thus exposing the emitter layer 48. As a result, the electron emitting element according to the sixth embodiment is manufactured, which has the structure shown in FIG. 9I.

When the sixth embodiment is used as a switching element, it operates in the same way as the second embodiment. Like the fifth embodiment, the sixth embodiment is advantageous in that the voltage drop in the gate wires 111*c* is less than in the fourth embodiment, because the gate wires 111*c* are made of metal. In view of this, the sixth embodiment is effective, particularly if it is large and the voltage drop in the wires 111*c* is too large to be neglected.

Figure 10:
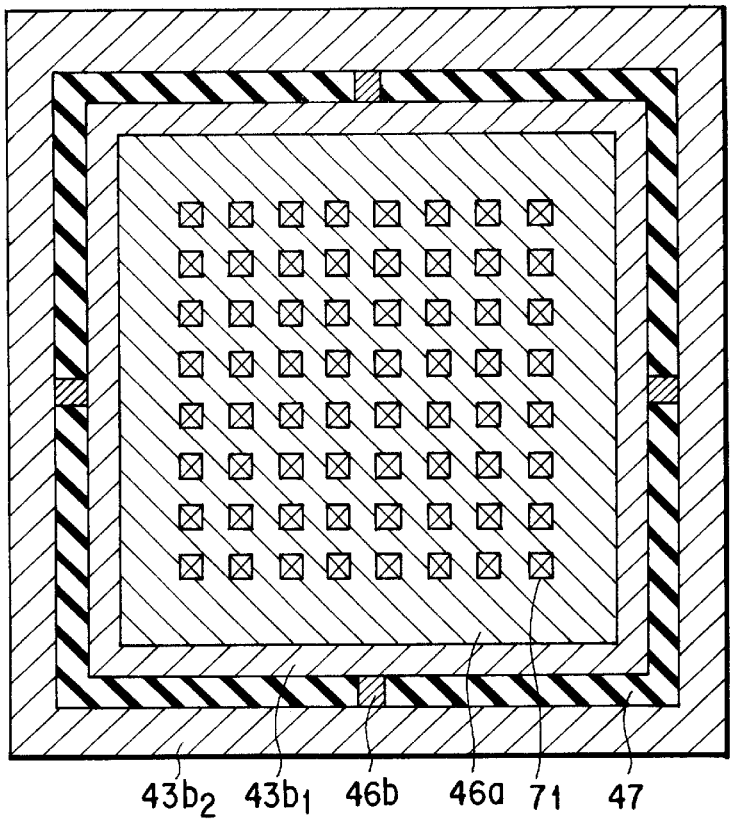
FIG. 10 is a plan view of an electron emitting element according to a seventh embodiment of the present invention.

FIG. 10 is a plan view of an electron emitting element according to the seventh embodiment of this invention. The components identical to those shown in FIGS. 6A to 6I are designated at the same reference numerals in FIG. 10 and will not be described in detail.

The seventh embodiment is characterized in that the resistor layer 46 is comprised of two layers 46A and 46B, so as to function efficiently. In FIG. 10, the numeral 71 indicates low-resistance emitter gate electrodes. The first resistance layer 46*a* is surrounded by a first n-type region $43b_1$ which works as a gate wire. The second resistance layer 46*b* is narrow, having been formed by patterning a thin, line-shaped resistor layer. A second n-type region $43b_2$ surrounds a $SiO_2$ layer 47 and functions as a gate wire.

Having the structure described above, the seventh embodiment can easily be manufactured by any one of the methods explained with reference to FIGS. 6A to 6I, FIGS. 8A to 8I and FIGS. 9A to 9I. For the sake of simplicity, the lengthwise direction of the n-type region 43*b* extends shall be called "column direction," and the widthwise direction thereof shall be called "line direction."

With the structure shown in FIG. 10 it is possible to reduce the width of the resistor layer 46*a*.

The fourth embodiment shown in FIG. 7B has only one resistor layer 46. The resistance of the emitter gate electrode 71 located nearer the n-type region $43b_1$ than any other emitter gate electrode 71 depends on the width of the resistor layer 46*a*. To maintain a resistor connected to this emitter gate electrode 71 at a predetermined resistance, the emitter gate electrode 71 and the n-type region must have widths greater than a predetermined value. The "predetermined value" is one that the resistors 33 need to have to enable the electron emitting element to operated well when it is used as a switching element.

By contrast to the fourth embodiment, the second resistor layer 46*b* is provided between the $SiO_2$ films 47 and is narrow in the column direction. The layer 46*b* need not be made broader to have a high resistance. As a result, it is unnecessary for the resistor layer 46*a* to have so high a resistance as in the fourth embodiment. The seventh embodiment can achieve the same advantage as the fourth embodiment even if the gate wire and the emitter gate electrode 71 which is nearer the gate wire have relatively small widths.

The two resistance layers 46*a* and 46*b* are connected in series. Instead, three or more resistance layers may be connected in the seventh embodiment.

Figure 11:
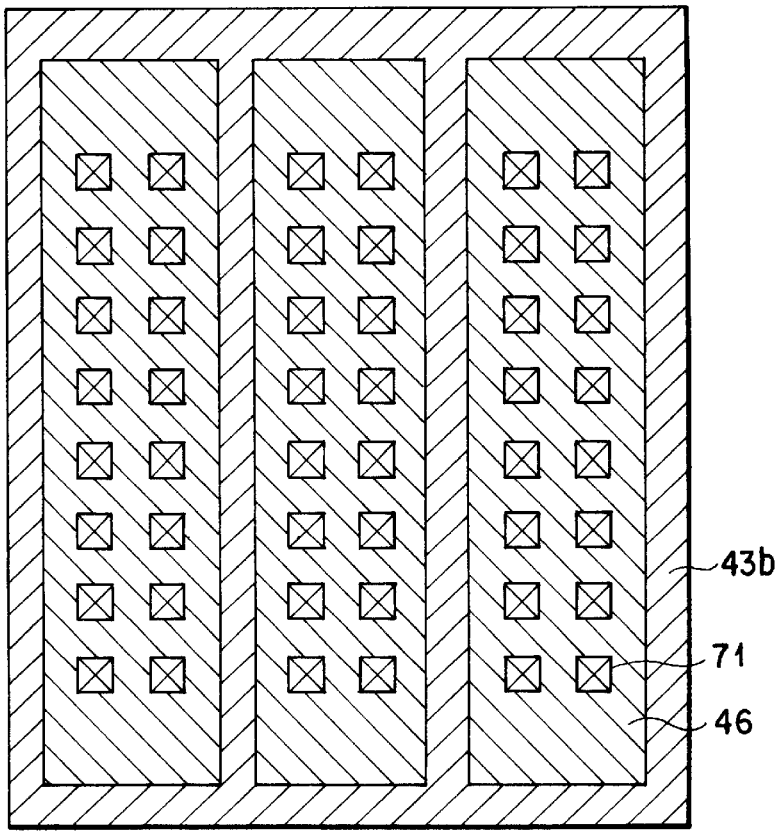
FIG. 11 is a plan view of an electron emitting element according to and eighth embodiment of the present invention.

FIG. 11 is a plan view of an electron emitting element according to an eighth embodiment of the present invention. The components identical to those shown in FIGS. 6A to 6I are designated at the same reference numerals in FIG. 11 and will not be described in detail.

The eighth embodiment is designed to solve the problem with the fourth embodiment. The problem is that the resistor layer does not effectively work for an emitter located in an edge part of the emitter array, though it functions effectively for an emitter located in the center part of the array.

In the fourth embodiment, the emitter gate electrodes 71 are shaped like islands and arranged on the resistor layers 46, as is illustrated in FIG. 7B. An emitter gate electrode 71 located in the center part of each resistor layer 46 is at a longer distance from the n-type region 43*b* which will be processed into gate wires, than an emitter gate electrode 71 located near an edge of the resistor layer 46. Inevitably, the resistors connecting the electrodes 71 and the gate wires have different resistances.

The seventh embodiment is similar to the fourth embodiment in that the n-type region 43*b* for forming gate wires opposes the emitter gate electrodes 71, with the resistor layer 46 interposed between the region 43*b* and the electrodes 71. In the seventh embodiment, however, the emitter gate electrodes 71 are located at the same distance from the n-type region 43*b,* as can be seen from FIG. 11. The resistors connected to the electrodes 71 therefore have the same resistance. Each emitter gate electrode 71 can perform switching operation in the same way as any other emitter gate electrode 71.

Shown in FIG. 11 are 48 emitter gate electrodes 71, which are spaced part by the same distance from the n-type region 43*b*. This does not mean that the number of emitters incorporated in the electron emitting element according to the eighth embodiment is limited to 48. Rather, the eighth embodiment may have more than ten thousand emitters. In this case, it is difficult to locate so many emitters at the same distance from the n-type region 43*b*. The emitters may be located at different distances from the region 43*b,* provided that the distance between the differences at which the nearest emitter and the remotest emitter are located from the region 43*b* falls within a prescribed range. If so, the eighth embodiment can attain the advantage expected of it.

Figure 12:
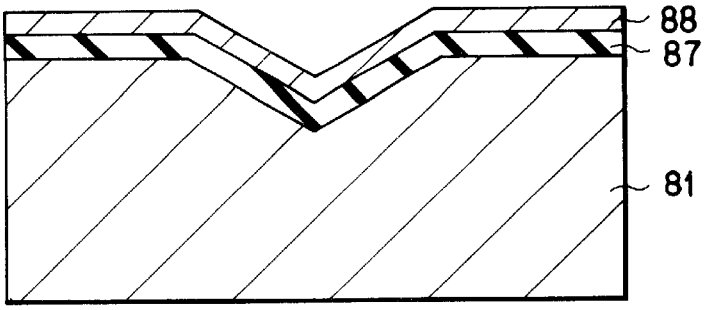
FIG. 12 is a sectional view of an electron emitting element according to a ninth embodiment of the present invention.

FIG. 12 is a sectional view of an electron emitting element according to the ninth embodiment of the invention. The ninth embodiment is a modification of the sixth embodiment. It can be further modified to become the fourth embodiment (FIG. 6F) and the fifth embodiment (FIG. 8E).

As shown in FIG. 12, the electron emitting element according to the ninth embodiment comprises a p-type silicon substrate 81, an $SiO_2$ film 87 formed on the substrate 81 by thermal oxidation, and a carbon emitter layer 88 provided on the film 87. The carbon emitter layer 88 is formed by hot-filament method.

More specifically, urea used as dopant is dissolved in acetone. Acetone fed at flow rate of 0.5 sccm and hydrogen ($H_2$) fed at flow rate of 100 sccm are mixed, forming a mixture gas. The mixture gas is applied at pressure of 150 Torr and at the substrate temperature of 800° C., forming a carbon layer having a thickness of 0.1 $\mu$m. Further, the substrate temperature is lowered from 800° C. to 300° C., at the rate of 5° C./min, thereby growing the carbon layer. A graded layer having a thickness of 1 $\mu$m to several microns is thereby formed. The substrate temperature may not be maintained at 800° C. at which an n-type diamond layer is formed, in order to form a perfectly graded layer only. In the above process steps, the microwave CVD or ECRCVD may be used instead of the above hot filament method. To make graded layer, not only the temperature, but also the pressure or gas composition may be changed.

Thus, a graded layer can be formed, whose composition continuously changes in its thickness direction. Then, an adhesion layer 49 (FIG. 9C) is formed on the layer 88. The layer 49 is made of Mo, Al, Ti, or the like. If made of any one of these materials, the adhesion layer 49 can be used as the electrode for the carbon emitter layer 88.

Figure 13A:
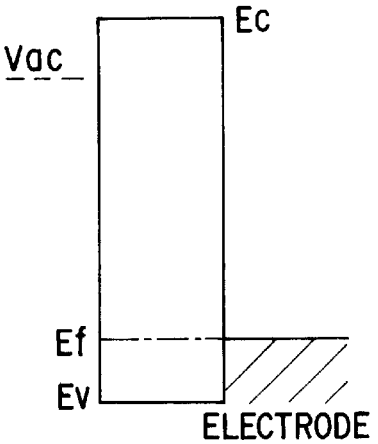
FIGS. 13A and 13B are diagrams representing two different energy bands the emitter layer of the electron emitting element shown in FIG. 12 takes in different conditions.
Figure 13B:
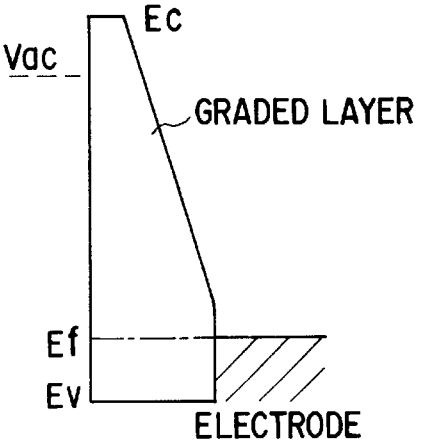

FIG. 13A is a diagram showing the energy band the carbon emitter layer 88 has when the composition of the layer 88 is not altered. FIG. 13B is a diagram showing the energy band the carbon emitter layer 88 has when the composition of the layer 88 is altered. In FIGS. 13A and 13*b,* Ec is the conduction band, Ef is the Fermi level, Ev is the valence band, and Vac is the vacuum level.

As seen from FIG. 13B, the emitter tip becomes a diamond tip as the layer 88 is made to grow in an 800° C. atmosphere. That part of the layer 88, which is below the emitter tip gradually, changes from diamond to amorphous carbon. Hybridized orbital of Sp3 is dominant at the emitter tip, i.e., the diamond tip. At the amorphous carbon, combination of Sp2 increases, reducing the energy gap of the emitter. That is, the band gap of the emitter decreases continuously.

Figure 14:
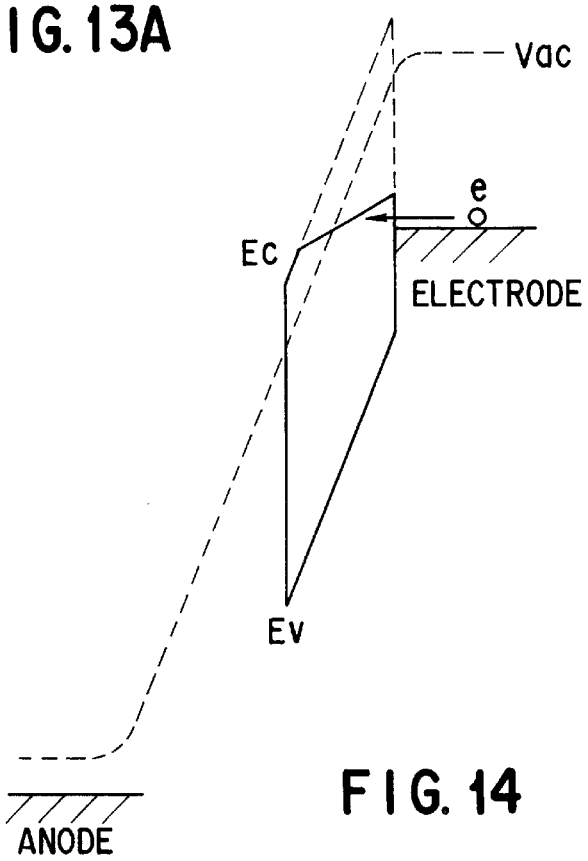
FIG. 14 is an energy-band diagram for explaining the operation of the electron emitting element shown in FIG. 12.

FIG. 14 is an energy-band diagram showing how the electron emitting element according to the ninth embodiment operates if it has an anode. The graded carbon emitter layer facilitates the tunnel injection of electrons from the anode to the emitter. As shown in FIG. 14, the band gap is broadened toward the surface of the emitter. Hence, the electron is easily supplied from the back contact layer to electron emitting element, while emitting electrons from the emitter at as low a voltage as possible. The back contact layer is made of Mo, Al or Ti. Instead, it can be made of conductive graphite.

As has been described, in the electron emitting element and the switching circuit using the element, both according to the present invention, a resistor is connected between the gate and the line for supplying a signal to the gate, thereby to change the voltage actually applied to the gate so that almost no current flows in the gate. Thus, the power loss in the gate can be minimized, and the electron emitting element can hardly be broken down.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A power switch device including an electron emitting element connected in series to a series circuit including a signal source, a voltage source and a load, comprising:

an emitter electrode configured to emit electrons when applied with an electric field;

a gate electrode configured to extract the electrons emitted from the emitter electrode, when applied with a voltage from the signal source, said voltage being positive with respect to the emitter electrode;

an anode electrode connected to the load and configured to collect the electrons extracted by the gate electrode, to flow an anode current through the anode electrode; and a gate resistor connected between the signal source and the gate electrode, wherein the power switch device has V-I characteristic of the load including a linear domain in which the anode current increases in correspondence with an increase of the anode voltage and a saturation domain indicating a constant anode current, and the gate resistor has a resistance for generating a gate voltage by which the power switch device is turned on at the linear domain.

2. The power switch device according to claim 1, wherein the gate resistor has such a resistance as renders the gate voltage applied to the gate electrode higher than a gate voltage determined by correlation of the V-I characteristic of the load and V-I characteristic of the anode current.

3. The power switch device according to claim 2, wherein the gate resistor has a resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

4. The power switch device according to claim 1, wherein the emitter electrode has a plurality of emitter elements arranged in a two-dimensional plane, the gate electrode has a plurality of gate elements, each provided for at least one emitter element, and the gate resistor has a plurality of resistor elements connected between the gate elements and the signal source.

5. The power switch device according to claim 4, wherein the resistor elements have such resistances as render the gate voltage applied to the gate electrode higher than a gate voltage determined by correlation of the V-I characteristic of the load and V-I characteristic of the anode current.

6. The power switch device according to claim 5, wherein the resistor elements have resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

7. The power switch device according to claim 1, wherein the emitter electrode, the gate electrode and the gate resistor are formed together on a substrate.

8. A power switch device including an electron emitting element connected in series to a series circuit including a signal source, a voltage source and a load, comprising:

an emitter electrode configured to emit electrons when applied with an electric field;

a gate electrode configured to extract the electrons emitted from the emitter electrode, when applied with a voltage from the signal source, said voltage being positive with respect to the emitter electrode;

an anode electrode connected to the load, and configured to collect the electrons extracted by the gate electrode and pass an anode current through the anode electrode; and a control circuit connected to the gate electrode and the emitter electrode and configured to decrease a gate current flowing in the gate electrode without changing the anode current, the control circuit having a gate resistor between the signal source and the gate electrode and having such a resistance as to generate a gate voltage by which the power switch device is turned on at a linear domain of V-I characteristic of the load, the linear domain having characteristic wherein the anode current increases in correspondence with an increase of the anode voltage.

9. The power switch device according to claim 1, wherein the emitter electrode has a band gap continuously changed.

10. The power switch device according to claim 1, wherein the emitter electrode is made of carbon material.

11. The power switch device according to claim 1, wherein the emitter electrode has a tip and a band gap broadening toward the tip.

12. A switching device used for switching a load, comprising:

an electron emitting element comprising an emitter electrode configured to emit electrons when applied with an electric field, a gate electrode configured to extract the electrons emitted from the emitter electrode, and an anode electrode configured to collect the electrons extracted by the gate electrode;

a signal source configured to apply a voltage to the gate electrode, said voltage being positive with respect to the emitter electrode;

a gate resistor connected in series between the signal source and the gate electrode and having a resistance for generating a gate voltage by which the switching device is turned on at a linear domain of V-I characteristic of the load, the linear domain having characteristic wherein the anode current increases in correspondence with an increase of the anode voltage; and a voltage source connected in series to the load and configured to apply a positive voltage higher than the gate voltage to the anode electrode.

13. The switching device according to claim 12, wherein the gate resistor has such a resistance as renders the gate voltage applied to the gate electrode higher than a gate voltage determined by correlation of the V-I characteristic of the load and V-I characteristic of the anode current.

14. The switching device according to claim 13, wherein the gate resistor has a resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

15. The switching device according to claim 12, wherein the emitter electrode has a plurality of emitter elements arranged in a two-dimensional plane, the gate electrode has a plurality of gate elements, each provided for at least one emitter element, and the gate resistor has a plurality of resistor elements connected between the gate elements and the voltage source.

16. The switching device according to claim 15, wherein the resistor elements have such resistances as render the gate voltage applied to the gate electrode higher than a gate voltage determined by correlation of the V-I characteristic of the load and V-I characteristic of the anode current.

17. The switching device according to claim 16, wherein the resistor elements have resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

18. The switching device according to claim 12, wherein the emitter electrode, the gate electrode and the gate resistor are formed together on a substrate.

19. An electron emitting element comprising:

a first conductive layer formed on a substrate and having a plurality of projecting emitters;

an insulating layer provided on the first conductive layer and covering the first conductive layer, except tips of the projecting emitters; and a second conductive layer covering the insulating layer and having openings over the tips of the emitters, said second conductive layer consisting of a plurality of gate electrodes made thick and located around the emitters, respectively, a gate wire layer made thick and spaced from the gate electrodes by a predetermined distance, and resistor layers interposed between the gate electrodes and the gate wire layer and made thinner than the gate electrodes and the gate wire layer.

20. An electron emitting element according to claim 19, wherein the resistor layers have been formed by making thinner than the gate electrodes those parts of the second conductive layer which are interposed between the gate electrodes and the gate wire layer.

21. An electron emitting element, comprising:

an emitter electrode configured to emit electrons when applied with an electric field;

a gate electrode configured to extract the electrons emitted from the emitter electrode, when applied with a voltage from a signal source, the voltage being positive with respect to the emitter electrode;

an anode electrode connected to a load and configured to collect the electrons extracted by the gate electrode and pass an anode current; and a gate resistor connected between the signal source and the gate electrode and configured to reduce a gate current flowing in the gate electrode, without changing an anode current flowing in the anode and lower a gate voltage by utilizing a voltage drop caused by the gate current, the gate resistor having such a resistance as renders the gate voltage applied to the gate electrode higher than a gate voltage determined by correlation of V-I characteristic of the load and V-I characteristic of the anode current, wherein the gate resistor has a resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

22. An electron emitting element, comprising:

an emitter electrode configured to emit electrons when applied with an electric field;

a gate electrode configured to extract the electrons emitted from the emitter electrode, when applied with a voltage from a signal source, the voltage being positive with respect to the emitter electrode;

an anode electrode connected to a load and configured to collect the electrons extracted by the gate electrode, and pass an anode current; and a gate resistor connected between the signal source and the gate electrode and configured to reduce a gate current flowing in the gate electrode, without changing an anode current flowing in the anode and lower a gate voltage by utilizing a voltage drop caused by the gate current, wherein the emitter electrode has a plurality of emitter elements arranged in a two-dimensional plane, the gate electrode has a plurality of gate elements, each provided for at least one emitter element, and the gate resistor has a plurality of resistor elements connected between the gate elements and the signal source, the resistor elements have such resistances as render the gate voltage applied to the gate electrode higher than a gate voltage determined by correlation of V-I characteristic of the load and V-I characteristic of the anode current, and the resistor elements have resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

23. A switching circuit, comprising:

an electron emitting element comprising an emitter electrode configured to emit electrons when applied with an electric field, a gate electrode configured to extract the electrons emitted from the emitter electrode, and an anode electrode configured to collect the electrons extracted by the gate electrode;

a signal source configured to apply a voltage to the gate electrode, the voltage being positive with respect to the emitter electrode;

a gate resistor connected in series between the signal source and the gate electrode and configured to reduce a gate current flowing in the gate electrode, without changing an anode current flowing in the anode, and for lowering a gate voltage by utilizing a voltage drop caused by the gate current;

a voltage source configured to apply a positive voltage higher than the gate voltage to the anode electrode; and a lead connected in series to the voltage source, wherein the gate resistor has such a resistance as renders the gate voltage applied to the gate electrode higher than a gate voltage determined by correlation of V-I characteristic of the load and V-I characteristic of the anode current, and the gate resistor has a resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

24. A switching circuit, comprising:

an electron emitting element comprising an emitter electrode for emitting electrons when applied with an electric field, a gate electrode for extracting the electrons emitted from the emitter electrode, and an anode electrode for collecting the electrons extracted by the gate electrode;

a signal source for applying a voltage to the gate electrode, said voltage being positive with respect to the emitter electrode;

a gate resistor connected in series between the signal source and the gate electrode, for reducing a gate current flowing in the gate electrode, without changing an anode current flowing in the anode, and for lowering a gate voltage by utilizing a voltage drop caused by the gate current;

a voltage source configured to apply a positive voltage higher than the gate voltage to the anode electrode; and a load connected in series to the voltage source, wherein the emitter electrode has a plurality of emitter elements arranged in a two-dimensional plane, the gate electrode has a plurality of gate elements, each provided for at least one emitter element, and the gate resistor has a plurality of resistor elements connected between the gate elements and the signal source, the resistor elements have such resistances as render the gate voltage applied to the gate electrode higher than a gate voltage determined by correlation of V-I characteristic of the load and V-I characteristic of the anode current, and the resistor elements have resistance higher than $(V_{g1}-V_{th})/I_{g5a}$, where $I_{g5a}$ is the gate current, $V_{th}$ is a gate voltage at which the emitter electrode starts emitting electrons, and $V_{g1}$ is a gate voltage.

* * * * *

UNITED STATES PATENT AND TRADEMARK OFFICE

CERTIFICATE OF CORRECTION

PATENT NO. : 6,323,831 B1
DATED : November 27, 2001
INVENTOR(S) : Tomio Ono et al.

It is certified that error appears in the above-identified patent and that said Letters Patent is hereby corrected as shown below:

Column 18,
Beginning at line 44, delete Claim 19.
Beginning at line 60, delete Claim 20.

Signed and Sealed this

Fifteenth Day of October, 2002

*Attest:*

*Attesting Officer*

JAMES E. ROGAN
*Director of the United States Patent and Trademark Office*